US009371147B2

(12) United States Patent
Straver

(10) Patent No.: US 9,371,147 B2
(45) Date of Patent: Jun. 21, 2016

(54) METHOD AND ARRANGEMENT FOR PACKING AT LEAST ONE ARTICLE IN A CONTAINER AND PLURALITY OF TYPES OF CONTAINERS FOR SHIPPING ARTICLES

(75) Inventor: Frederik Straver, Ev Laren (NL)

(73) Assignee: Storopack Hans Reichenecker GmbH, Metzingen (DE)

( * ) Notice: Subject to any disclaimer, the term of this patent is extended or adjusted under 35 U.S.C. 154(b) by 685 days.

(21) Appl. No.: 13/372,781

(22) Filed: Feb. 14, 2012

(65) Prior Publication Data

US 2013/0205724 A1 Aug. 15, 2013

(51) Int. Cl.

| | |
|---|---|
| ***B65B 67/02*** | (2006.01) |
| ***B65B 57/00*** | (2006.01) |
| ***B65B 55/20*** | (2006.01) |
| ***B65B 57/10*** | (2006.01) |

(52) U.S. Cl.

CPC ..... *B65B 67/02* (2013.01); *B65B 55/20* (2013.01); *B65B 57/00* (2013.01); *B65B 2210/04* (2013.01)

(58) Field of Classification Search

CPC ..... B31D 5/0073

USPC ..... 53/52, 403, 79, 445, 139.5, 155, 474, 53/238, 503, 504, 168; 493/350, 352, 464, 493/967

See application file for complete search history.

(56) References Cited

U.S. PATENT DOCUMENTS

| | | | | |
|---|---|---|---|---|
| 4,102,364 | A * | 7/1978 | Leslie et al. | 141/4 |
| 4,630,428 | A * | 12/1986 | Lesch | 53/474 |
| 5,348,157 | A * | 9/1994 | Pozzo | 206/522 |
| 5,397,000 | A * | 3/1995 | Holte et al. | 206/545 |
| 5,552,003 | A * | 9/1996 | Hoover et al. | 156/147 |
| 5,862,914 | A * | 1/1999 | Farison et al. | 206/522 |
| 5,901,850 | A * | 5/1999 | Jones et al. | 206/522 |
| 6,253,806 | B1 * | 7/2001 | Sperry et al. | 141/314 |
| 6,561,236 | B1 * | 5/2003 | Sperry et al. | 141/314 |
| 6,877,297 | B2 * | 4/2005 | Armington et al. | 53/502 |
| 7,254,932 | B2 * | 8/2007 | Tanaka et al. | 53/472 |
| 7,337,595 | B2 * | 3/2008 | Harding | 53/504 |
| 7,584,592 | B2 * | 9/2009 | Gabrielson et al. | 53/445 |
| 8,234,844 | B2 * | 8/2012 | Davlin et al. | 53/456 |
| 8,281,928 | B2 * | 10/2012 | Smith | 206/522 |
| 2005/0050848 | A1 * | 3/2005 | Harding | 53/58 |

(Continued)

FOREIGN PATENT DOCUMENTS

| | | |
|---|---|---|
| EP | 1884483 | 2/2008 |
| EP | 1786682 | 2/2009 |
| EP | 2407389 A1 | 1/2012 |

(Continued)

OTHER PUBLICATIONS

EP 10 00 7265 European Search Report.

*Primary Examiner* — Andrew M Tecco
*Assistant Examiner* — Praachi M Pathak
(74) *Attorney, Agent, or Firm* — Wood, Herron & Evans, LLP

(57) ABSTRACT

An arrangement for packing at least one article in a container comprises an automatic picking list generation means (136) generating a picking list (138) which specifies at least the at least one article to be placed in the container; closing means (142) for closing the container; and inflating means (146) for inflating a dunnage bag provided in the closed container. The invention proposes that the arrangement further comprises automatic bag type selection means (134) for selecting a type of the inflatable dunnage bag to be used, the selection depending at least on a parameter of the container.

10 Claims, 6 Drawing Sheets

(56) References Cited

U.S. PATENT DOCUMENTS

| | | | | |
|---|---|---|---|---|
| 2005/0055181 | A1* | 3/2005 | Verdura et al. | 703/1 |
| 2005/0055987 | A1* | 3/2005 | White et al. | 53/495 |
| 2008/0098699 | A1* | 5/2008 | Cheich et al. | 53/472 |
| 2011/0016833 | A1* | 1/2011 | Carlson et al. | 53/473 |
| 2012/0294692 | A1* | 11/2012 | Root | 410/119 |

FOREIGN PATENT DOCUMENTS

| | | |
|---|---|---|
| WO | 2009123919 | 10/2009 |
| WO | 2010076026 | 7/2010 |

* cited by examiner

METHOD AND ARRANGEMENT FOR PACKING AT LEAST ONE ARTICLE IN A CONTAINER AND PLURALITY OF TYPES OF CONTAINERS FOR SHIPPING ARTICLES

The invention relates to a method for packing at least one article in a container, to an arrangement for packing at least one article in a container, and to a plurality of types of containers for shipping articles, according to preambles of the independent claims.

End of line packaging of random products usually involves the application of protective dunnage- or stuffing materials preventing damage to the packed articles during shipping. This dunnage very often consists of multiple air-bags on a chain, machine-crumpled paper or loose fill chips. After the application of the dunnage material the container is closed by means of adhesive tape, straps or clamps.

In the logistic process in a warehouse, two methods of processing cardboard type containers can be distinguished: in line packing, also called "speed line", and off-line packing. In an in line packing process the articles are picked and put directly into the final container. At the end of the line, dunnage, for example air-bags, is applied by hand, after which the container is moved into a taping or strapping machine, where it is closed. If a high throughput is required, two packers per packing line are involved: the first packer applies air-bags, the second packer manually folds the lids of the container before moving the same into the taping or strapping machine. In an off line packing process, the articles are picked in totes or on carts and automatically or by hand forwarded to individual packing stations. At each packing station, one single packer is involved in checking the picks, selecting the container-size, packing the articles into the container, securing the articles with dunnage material, adding paperwork and closing the container.

The application of dunnage material is relatively time consuming. The packer has to judge the amount of dunnage material and the way the dunnage material is applied. In order to achieve good protection during transportation, a certain amount of over fill is needed. After tightly closing the container, the articles should remain blocked and thus being prevented from moving inside the container during shipment.

Inflatable dunnage bags to be placed in a container and to be inflated after the container has been closed, as well as methods of their application, are disclosed in WO 2007/087158 A1 and WO 99/52772 A1.

It is an object of the present invention to provide a method and an arrangement and containers that improve the economy and reliability of in line packing as well as of off line packing.

The invention proposes a method and an arrangement for packing at least one article in a container, and a plurality of containers, according to the independent claims. Embodiments of the invention are claimed in the dependent claims. Further important features of the invention are disclosed in this specification and in the attached drawing.

A major benefit of the invention is increased productivity (faster handling) and more defined blockage of articles inside the container due to the specific inflatable dunnage bag selected for the specific packing situation defined by parameters of the container and/or parameters of the articles to be packed. Less manpower is needed for packing a container when applying the invention. Further, the protection of the packed articles becomes more independent from the packer's judgment to add (or not) dunnage. The invention can easily be implemented and installed also in existing systems. Productivity also is increased due to space savings for machines and accumulators for dunnage material on, around and above the packing stations.

In case of an in line process, the complete process usually is driven by warehouse management software (WMS). This software determines what container-size is needed for each individual order and then normally generates a command for one of the automatic case erector machines (if installed) to unfold a corrugated container. Such a container is very shortly stopped after the case erector machine and brought in position for an automatic drilling machine (if installed), which creates at least one hole at a defined location in a wall of the container, normally close to an upper corner of the container. If more than one hole is provided, the holes may have different diameters. If more than one case erector machines are in use, a drilling machine after each case erector machine will be installed. The location of the hole is normally defined per type of container. As such, the at least one hole is provided on-site. It is, however, also possible to provide containers with at least one pre-drilled or pre-punched hole, the hole e.g. being provided already in the flat corrugated cardboard which is used to make the 3D-container.

After applying the hole(s), the container moves automatically to the picking area to collect all ordered articles. At the last picking position one single empty inflatable dunnage bag is connected with its inflation valve with one hole of the container, which is in most cases a corrugated box. Normally, at several locations in the picking area, such empty inflatable dunnage bags are available to be connected to the container by the picker.

It is desirable that the inflatable dunnage bags are fitted with a special inflation valve that, among other things, contains a clip for fixing the inflation valve to the designated hole in the wall of the container. Thus, the empty inflatable dunnage bag is precisely positioned in the container such that it reliably covers the articles placed in the container. Due to the preferred position of that hole adjacent to an upper corner of the container, the mounted inflation valve is adjusted and securely held at its position.

Various shapes and sizes of inflatable dunnage bags are available, all with the exact same inflation valve. In one preferred case, the size of the inflatable dunnage bag is allocated to the size of the corrugated container. As the WMS determines the container size, the size of the inflatable dunnage bag should automatically be determined therewith. The WMS also should add the selected type of inflatable dunnage bag to the picking list and preferably may take care that the container stops at the proper picking location and moves on only after the picker has properly connected the specified inflatable dunnage bag to the container.

After leaving the picking area, the container may be transported to an automatic container closing station (if installed). The closed lids or the closed cover of the container will block the inflation valve from the top-side, so that it is completely locked in the desired position. After closing, the container moves to the dunnage bag inflating station. Here, the container is positioned and held such that an inflation nozzle may move towards the hole and automatically fill the dunnage bag with a gaseous medium, for instance air through its inflation valve. The inflation valve is designed as a simple check valve preventing air from flowing out of the dunnage bag after inflation.

Due to the air pressure, combined with the flexibility of the material of the dunnage bag, the inflated dunnage bag fills up void space above and partly in between the articles in the container. The bottom shape of the inflated dunnage bag will follow the contours of the articles inside the container, thus fixing them against the bottom and side walls of that container.

The exact extent of inflation may be determined by measuring a displacement of a wall of the container during inflation. At this purpose, a sensor may be provided that monitors the displacement of a wall (e.g. the top or cover side) of the container. When a threshold value is reached, the supply of air to the dunnage bag is stopped, and the container moves on to the expedition station of the warehouse. In an alternative embodiment, the valve itself comprises means coming into contact with the expanding bag during its inflation and being displaced by this contact. Since an additional hole is provided in the box just at the location of the means, the displacement of the means can be detected and measured from outside, for instance by an ultrasonic measurement system. If the displacement passes a threshold value, inflation is stopped.

Also in case of an off line process, one of the packer's tasks is to add protective dunnage material to the container with ordered articles. With the invention, the picking list or order line overview on packer's computer screen shows, next to the box type, exactly what type of inflatable dunnage bag is to be used. This information is provided by the WMS-software. If the software is unable to provide this information, the packer may select the type of inflatable dunnage bag depending on the parameters (e.g. size) of the container, using a known allocation of types of inflatable dunnage bags to types of containers. Therefore, it is easy for the packer to pick the right type of inflatable dunnage bag.

For this purpose, a plurality of types of containers for shipping articles may be provided, the types of containers within the plurality of types of containers differing from each other at least in one of shape and size, characterized in that a type of inflatable dunnage bag is allocated to each type of container, the type being selected from a plurality of types of inflatable dunnage bags, the types of inflatable dunnage bags within the plurality of types of inflatable dunnage bags differing from each other at least in one of shape and size.

The container may be delivered from the container supplier already with one hole at a defined location, or with two holes at different defined locations, such that there is no on-site drilling of the hole(s) necessary. After the packer has checked and arranged all articles and paperwork in the container, the last act is to prick the inflation valve with the empty inflatable dunnage bag in the hole specifically provided for this purpose. The position of that hole should be considered always to be in the same direction (facing or not facing the packer).

The container then moves to an automatic container closing machine (if installed) and to an inflation station, where the dunnage bag is inflated to a defined level.

More in detail, the bag type selection may be performed by an automatic bag type selection means, which may be a software module in the WMS and thus be easy to integrate.

The automatic picking list generation means may place the selected type of inflatable dunnage bag at the and of the picking list. This complies best with the normal work flow of packing a container.

The selected type of inflatable dunnage bag may be indicated to a user on a display, such that no modification of the picking list is necessary, or applicable in cases where no picking list is used.

The type of inflatable dunnage bag may be selected from a plurality of types of inflatable dunnage bags, the types of inflatable dunnage bags within the plurality of types of inflatable dunnage bags differing from each other at least in one of shape and size.

Further, the bag type selection may depend on at least one of a shape of the container to be used, a size of the container to be used, a presumed shape of the void space in the container to be used, a presumed amount of the void space in the container, a number of articles to be placed in the container, a shape of the at least one article to be placed in the container, and a size of the at least one article to be placed in the container.

Other features and advantages of the invention will become apparent from the following detailed description.

Figure 1:
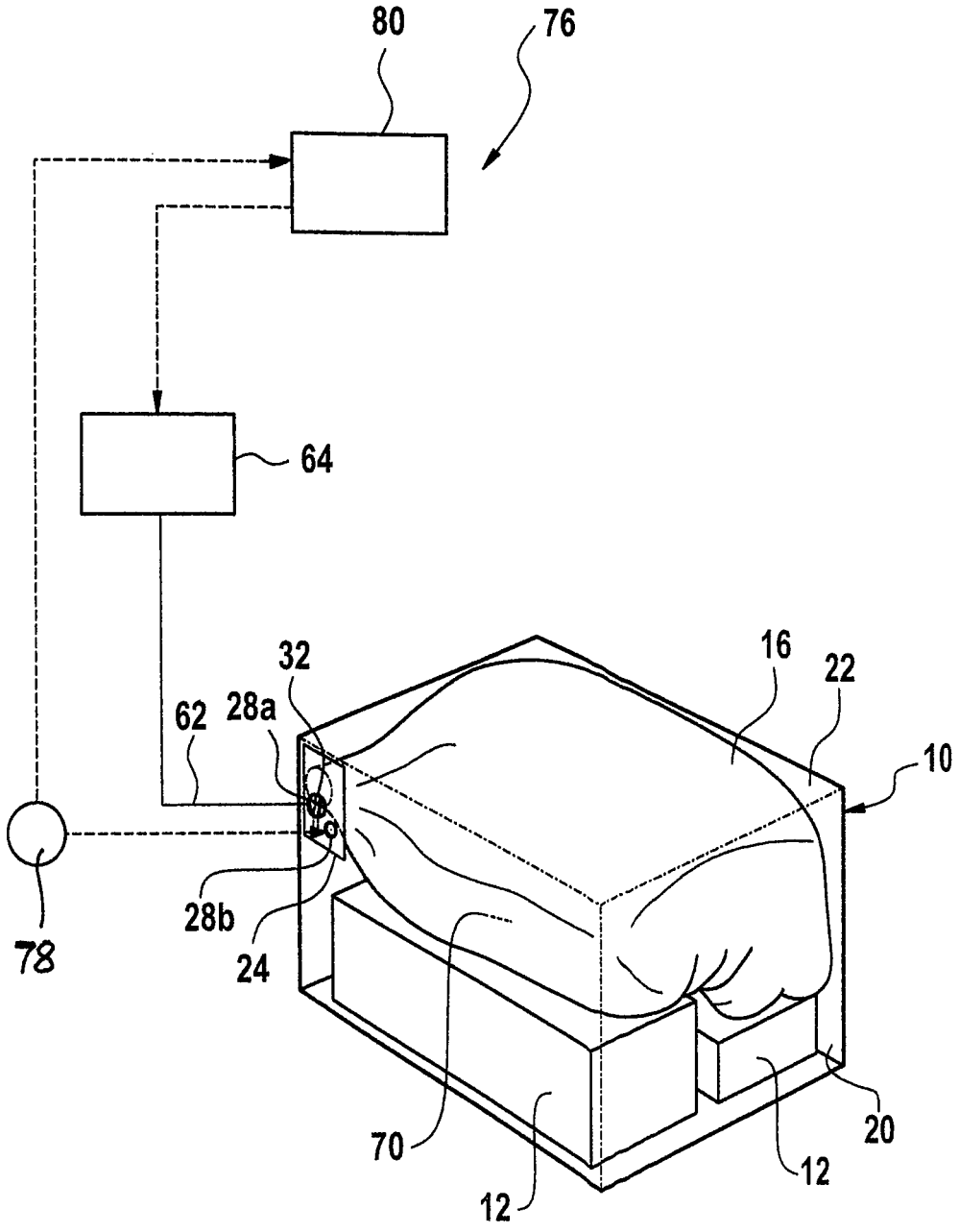
FIG. 1 is an overall perspective view of a container with two articles and an inflated dunnage bag placed inside.
Figure 2:
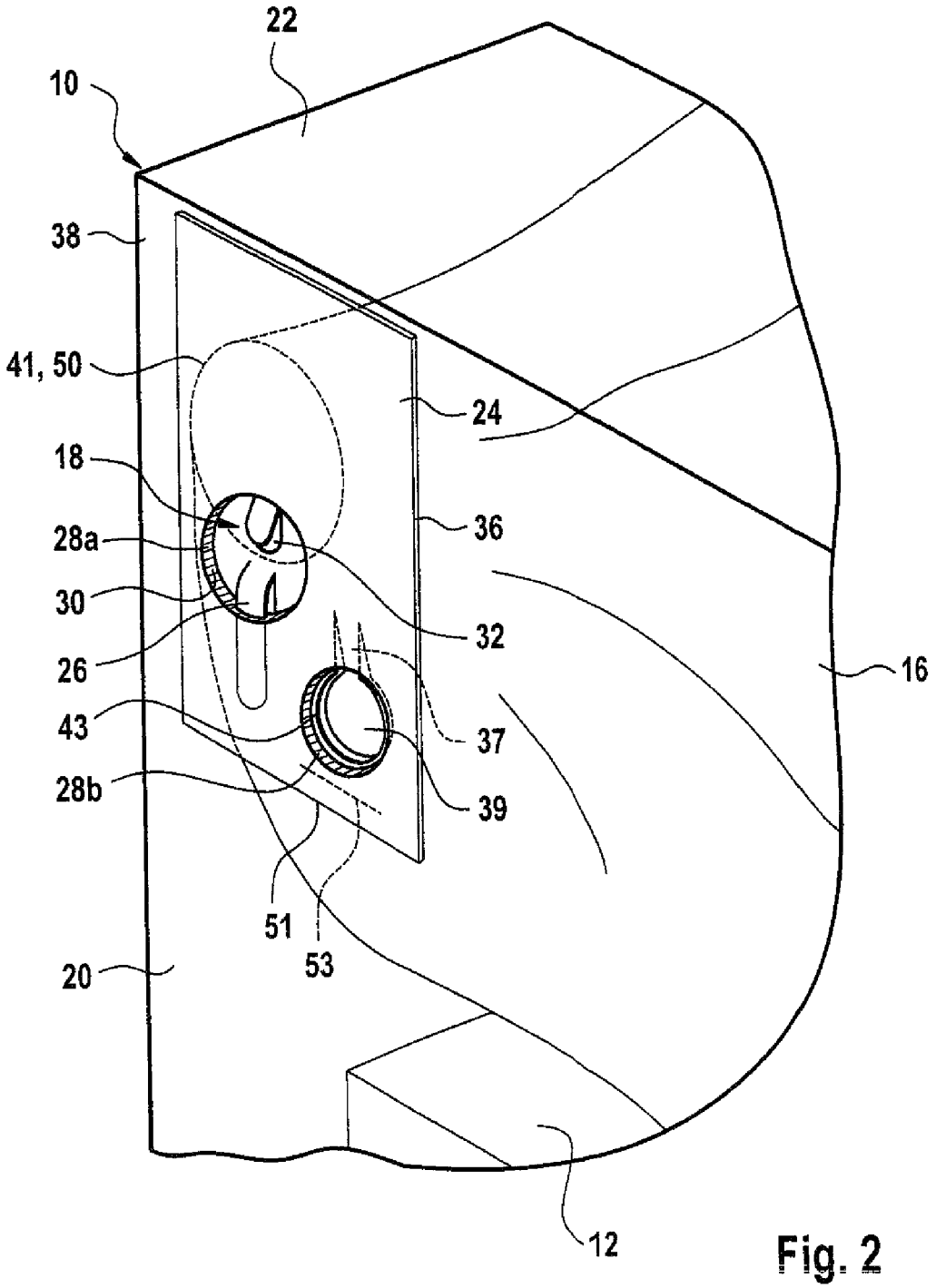
FIG. 2 is a more detailed perspective view of a portion of the container of FIG. 1.

Referring to FIGS. 1 and 2, a container 10 comprises two articles 12 and an inflated dunnage bag 16 for filling a void space in container 10. The inflated dunnage bag 16 comprises an inflation valve 18 for inflating the dunnage bag 16 with gas, e.g. air. The articles 12 are wedged between the inflated dunnage bag 16 and side walls 20 and top wall 22 of container 10 and between portions of inflated dunnage bag 16. Thus articles 12 are prevented from moving around in container 10 while being shipped.

Inflation valve 18 comprises a card-type solid member 24 made of a flat thin but rigid and rectangular sheet of polyethylene in one step by punching (or alternatively by molding). Solid member 24 comprises a clip- or hook-shape fixation portion 26, and side wall 20 of container 10 has two holes **28*a* and 28*b* nearby to an upper corner of container 10. Clip- or hook-shape fixation portion 26 is formed during molding of solid member 24 and looks like a punching-out, or is formed after molding by punching-out from solid member 24. As can best be seen from FIGS. 2 to 4, clip-shape fixation portion 26 is pierced downwardly into a circumferential surface 30 of hole 28*a* to attach solid member 24 very close and parallel to side wall 20 of container 10 and oriented with its longitudinal sides 36 parallel to vertical edges 38 of container 10. Inflation valve 18 further comprises a flat indication lid 39 flexibly and elastically hinged to solid member 24 by a hinge portion 37. Indication lid 39 and hinge portion 37 are formed either during molding of solid member 24 or after molding by punching-out from solid member 24, such that they are unitary with solid member 24. In its unloaded ("relaxed") position, the plane of indication lid 39 is distant from the plane of solid member 24 by a distance D in FIG. 4. Below indication lid 39, solid member 24 comprises an opening 43 having the same shape as indication lid 39 and hinge portion 37. Hole 28*b* of container 10 is positioned such that the opening 43 of solid member 24 is situated just underneath hole 28*b*, such that indication lid 39 can be seen from outside of container 10**.

Solid member 24 comprises an inflation opening 32 located nearby fixation portion 26. Inflation opening 32 is also formed when solid member 24 is molded by creating a clip- or hook-shape protrusion 34 of a shape similar to fixation portion 26, however having a shorter length. As may be seen from the figures, inflation opening 32 is located at hole 28 such that "it looks through hole 28", thus allowing to visually check the correct position of the inflation opening 32 from outside and allowing inflating dunnage bag 16 from outside of container 10, as will be explained in more detail further below.

Figure 3:
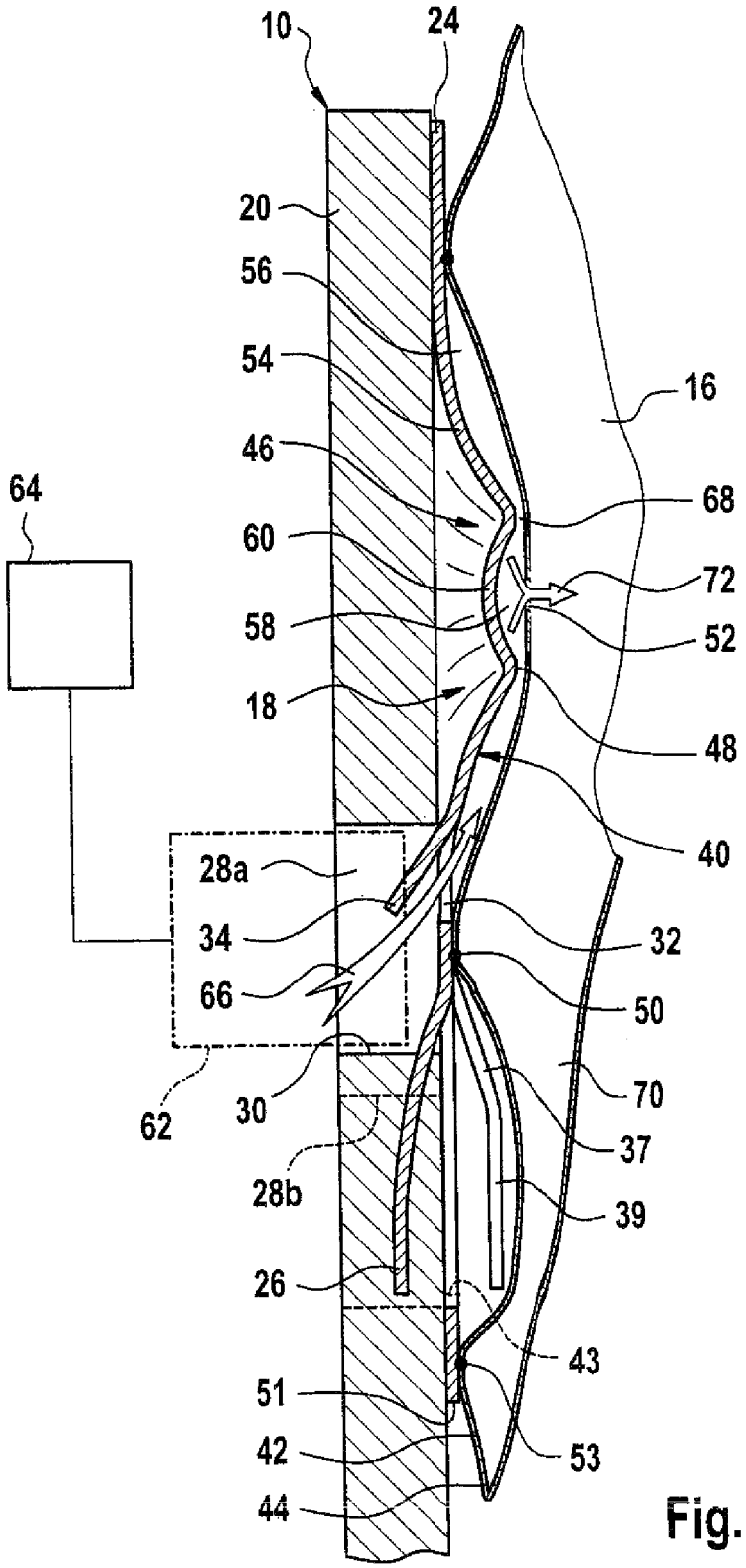
FIG. 3 is a sectional view through the portion shown in FIG. 2 during inflation of the inflatable dunnage bag.
Figure 4:
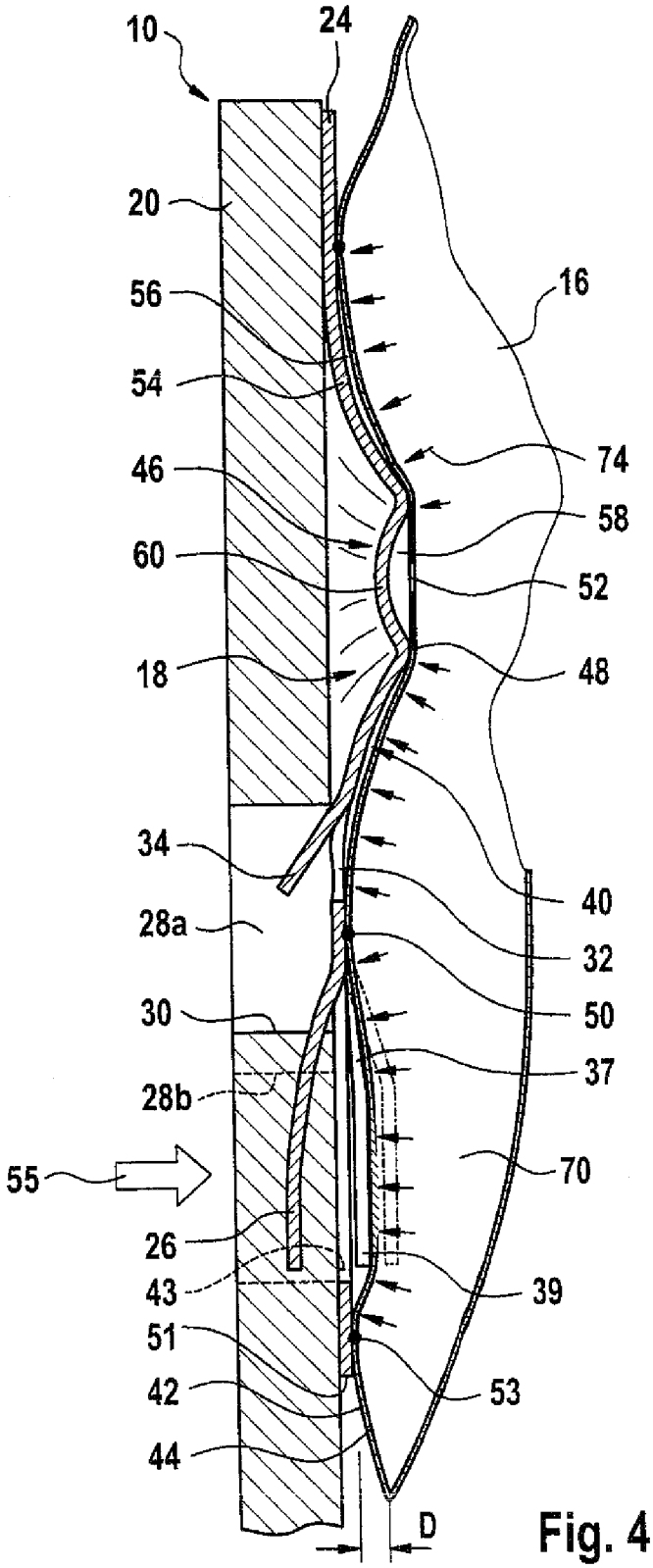
FIG. 4 is a view similar to FIG. 3 after inflation of the inflatable dunnage bag.

Referring now to FIGS. 3 and 4, design and functional principles of inflation valve 18 will be explained in more detail. Solid member 24 comprises an elevation 40, which in this preferred embodiment has a circular base area 41 (see FIG. 2) and thus is shaped like a volcanic cone. However, it is to be understood that other shapes of the elevation are suitable, such as shapes with a rectangular or triangular or oval base area. Indication lid 39 and elevation 40 are on the same side of solid member 24. The elevation 40 comprises atop 46 having a circumferential and in this preferred embodiment circular sealing rim 48.

An outer surface 42 of a wall 44 of inflatable dunnage bag 16 is gas-tightly fixed to solid member 24 along a circumferential, circular and line-like sealing area 50, the fixation being realized by plastic welding or any other appropriate thermal treatment, or e.g. by gluing. As can be seen from FIGS. 3 and 4, sealing area 50 is located at the foot of elevation 40 and thus distant from sealing rim 48 at the top 46 of elevation 40. It can be further noted from FIGS. 3 to 5 that inflation opening 32 is arranged between sealing area 50 and sealing rim 48, and that in this preferred embodiment the portion of wall 44 of inflatable dunnage bag 16 being located radially inwardly of sealing area 50 is elastically stretched when welding bag 16 to solid member 24 such that its outer surface 42 slightly contacts sealing rim 48. It is to be understood, however, that dunnage bag 14 may work also without wall 44 being elastically stretched.

The outer surface 42 of wall 44 of inflatable dunnage bag 16 is additionally fixed to solid member 24 at a position adjacent to an edge 51 of solid member 24, the edge being distal from elevation 40. The fixation (reference numeral 53) is realized e.g. by welding or gluing, and serves the purpose that the outside of the empty bag covers at any time the indication lid.

As can best be seen from FIGS. 3 and 4, wall 44 of dunnage bag 16 comprises an opening 52 being arranged radially inwardly of sealing rim 48 of elevation 40. Between outer surface 42 of inflatable dunnage bag 16 and a slope 54 of elevation 40 a space 56 is provided, the slope 54 being concavely formed away from outer surface 42 of dunnage bag 16. Similarly, a space 58 is provided between outer surface 42 of dunnage bag 16 and a top surface 60 of elevation 40, top surface 60 being arranged radially inwardly of sealing rim 48 and concavely formed away from outer surface 42 of dunnage bag 16.

FIGS. 3 and 4 show dunnage bag 14 after being fixed to side wall 20 of container 10 by piercing clip-shape fixation portion 26 into inner circumferential surface 30 of hole 28. For filling dunnage bag 16 with gas, e.g. air, a gas supply nozzle 62 is docked at hole 28, as shown in FIG. 3. Gas supply nozzle 62 is connected to a gas supply 64. When gas supply 64 is activated, gas flows through gas supply nozzle 62 and inflation opening 32 provided in solid member 24 into space 56 between slope 54 and wall 44 of dunnage bag 16, as is indicated by arrow 66.

The increasing pressure in this area elastically lifts outer surface 42 of dunnage bag 16 from sealing rim 48, such that gas can pass through a developing gap 68 between outer surface 42 and sealing rim 48 and further through opening 52 into inner volume 70 of dunnage bag 16, thus inflating dunnage bag 16, as indicated by arrow 72. With the increasing volume of dunnage bag 16 and the increasing pressure inside dunnage bag 16, outer surface 42 of wall 44 of dunnage bag 16 comes into contact with indication lid 39. When the pressure inside dunnage bag 16 reaches a certain level, outer surface 42 of wall 44 of dunnage bag 16 exerts a force onto indication lid 39 in the direction of solid member 24, such that indication lid 39 is elastically displaced (displacement D in FIG. 4) towards opening 43 and towards hole 28*b*. The degree of displacement D of indication lid 39 is an indication for the pressure level inside dunnage bag 16. Since the displacement D of indication lid 39 may be seen from outside of container 10 through opening 43 and hole 28*b* (see arrow 55 in FIG. 4), the inflation of dunnage bag 16 may be controlled even after closure of container 10. An example for such a control method is explained further below.

When gas supply 64 is deactivated, as shown in FIG. 4, the elastic tension of wall 44 of dunnage bag 16 and the gas pressure inside dunnage bag 16 press wall 44 of dunnage bag 16 onto sealing rim 48, as indicated by arrows 74, thus reliably sealing the inner volume 70 of dunnage bag 16 against the outer atmosphere.

A particularly advantageous method to use dunnage means 14 is now explained with reference to FIG. 1: The method uses a dunnage inflation device 76 comprising gas supply 64 and gas supply nozzle 62 as shown before, and additionally measuring means 78 for measuring a displacement of indication lid 39 through hole 28*b* in the side wall of container 10 during inflation of inflatable dunnage bag 16. Measuring means 78 may comprise an ultrasonic, an infrared, a laser measurement device or any other device to reliably measure a displacement of indication lid 39 during inflating dunnage bag 16. It is to be understood that the displacement to be measured is the one created by the inflation of dunnage bag 16.

Void filling device 76 further comprises a control unit 80 receiving measurement signals from measuring means 78, and providing control signals to gas supply 64. Control unit 80 comprises storage means for storing a predetermined maximum allowable value of displacement during inflation. In a non-shown embodiment, control unit 80 comprises means for determining the maximum allowable displacement value depending on actual parameters of container 10 (e.g. its size and/or shape and/or content) and/or on other parameters.

For filling a void space in a container 10 with dunnage means 16, container 10 is filled with articles 12, dunnage means 16 is fixed to container 10 as explained above, and container 10 is closed and placed such that measuring means 78 can measure the displacement of indication lid 39 through hole 28*b*. Thereafter, gas supply nozzle 62 is positioned close or connected to hole 28*a* or inflation opening 32, respectively, and control unit 80 is activated, for example by pushing a switch at gas supply nozzle 62. Control unit 80 then automatically activates gas supply 64 such that gas, e.g. air is fed into inner volume 70 of dunnage bag 16, as explained above. Control unit 80 comprises a monitoring circuit measuring the gas pressure at the exit of gas supply nozzle 62 and thus detecting if gas supply nozzle 62 is not sufficiently close or docked to inflation opening 32. In such a case, a warning signal is output and gas supply 64 is deactivated, and/or the container 10 is moved to a side track.

During inflation, dunnage bag 16 placed in the closed inner volume of container 10 expands and comes into contact with indication lid 39, thus exerting a pressure force onto indication lid 39, the direction of which being essentially orthogonal to the plane of indication lid 39. This pressure force increases with the amount of filling and leads to an outwardly oriented displacement D of indication lid 39, the displacement D being measured by measuring means 78. As soon as the measured displacement D of indication lid 39 reaches the predetermined limit value, which is selected such that the void space is sufficiently filled without damaging articles 12 or container 10, control unit 80 deactivates gas supply 64 and outputs a signal indicating to a user that filling the void space inside container 10 has been successfully completed.

Figure 5:
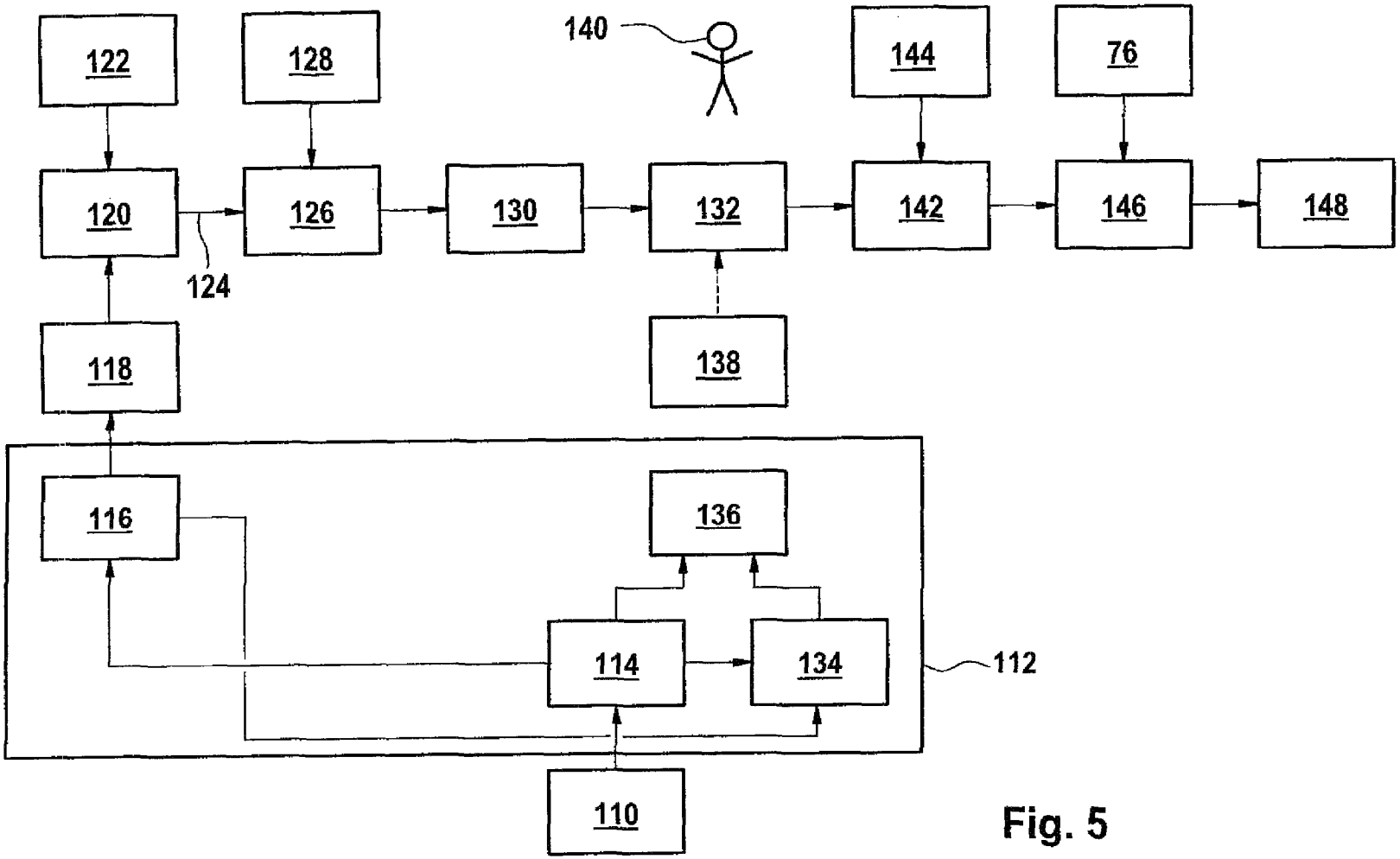
FIG. 5 is a schematic block diagram of an arrangement for an in line packing process.

Referring now to FIGS. 1 and 5, a typical in line process for picking articles 12 and placing them in container 10 is described: An order 110 is directed to a warehouse management system 112, which may be implemented as a computer program on a storage device of a computer. Warehouse management system 112 comprises article selection means 114 selecting articles 12 to be picked and packed into container 10, depending on their availability on stock. Article selection means 114 are connected to container type selection means 116 selecting a type of container 10 within a plurality of types of containers 10 differing from each other at least in one of shape and size. Container type selection means 116 are linked to an automatic container providing means 118 providing the selected type of container 10 in form of a flat corrugated cardboard raw material to a container erecting station 120 comprising an automatic container erecting machine 122. The latter erects the container 10 from the originally laid flat corrugated cardboard raw material by folding it to a 3D-container.

The erected container 10 then is transported by automatic conveying means 124 to a drilling station 126, where an automatic drilling machine 128 drills both holes 28*a* and 28*b* in the side wall 20 of container 10 at a predetermined position. Alternatively, already the flat corrugated cardboard raw material is provided with holes 28*a* and 28*b*, such that the drilling station 126 is not necessary. The drilled container 10 is then conveyed to a parking station 130 serving as buffer, and further to picking station 132.

Referring back to warehouse management system 112, it also comprises an automatic bag type selection means 134 selecting a type of inflatable dunnage bag 16 to be used depending on at least one of a parameter of container 10 and a parameter of article 12. More in detail, the type of inflatable dunnage bag 16 is selected from a plurality of types of inflatable dunnage bags 16, the types of inflatable dunnage bags 16 within the plurality of types of inflatable dunnage bags 16 differing from each other at least in one of shape and size. The selection of the type of dunnage bag 16 depends on at least one of a shape of the container 10 to be used, a size of the container 10 to be used, a presumed shape of the void space in the container 10 to be used, a presumed amount of the void space in the container 10 to be used, a number of articles 12 to be placed in the container 10, a shape of the article 12 to be placed in the container 10, and a size of the article 12 to be placed in the container 10. In a typical embodiment, there are provided three different types of dunnage bags 16 differing from each other only in size, the selection depending only on the size of the container 10 to be used.

Both the article selection means 114 and the bag type selection means 134 are connected to a picking list generation means 136 which generates a picking list 138 listing the articles 12 to be placed in the container 10 and, at the end of the picking list, also lists the type of container 10 and, next to this, the type of dunnage bag 16 to be placed in and fixed to container 10. The picking list 138 is presented to a user 140 (picker) as a print out and, optionally, also on a display such as a computer screen or a handheld terminal, at picking station 132.

The picker 140 at picking station 132 picks and places articles 12 as listed on the picking list into container 10, and then picks the type of dunnage bag 16 as specified on the picking list 138 and fixes the dunnage bag 16 to the hole 28 in the side wall 20 of the container 10.

Thereafter, the container 10 is conveyed to closing station 142 where it is closed by folding the open lids or placing a separate cover part and applying tapes. This is performed by a taping or strapping machine 144. Again, automatic conveying means 124 transport the now closed container 10 to inflation station 146, where the inflatable dunnage bag is inflated as explained above in connection with FIGS. 1, 3 and 4, using dunnage bag inflation device 76. At the end, the container 10 is transported to expedition station 148 for final shipment to an ordering person or an ordering entity.

Figure 6:
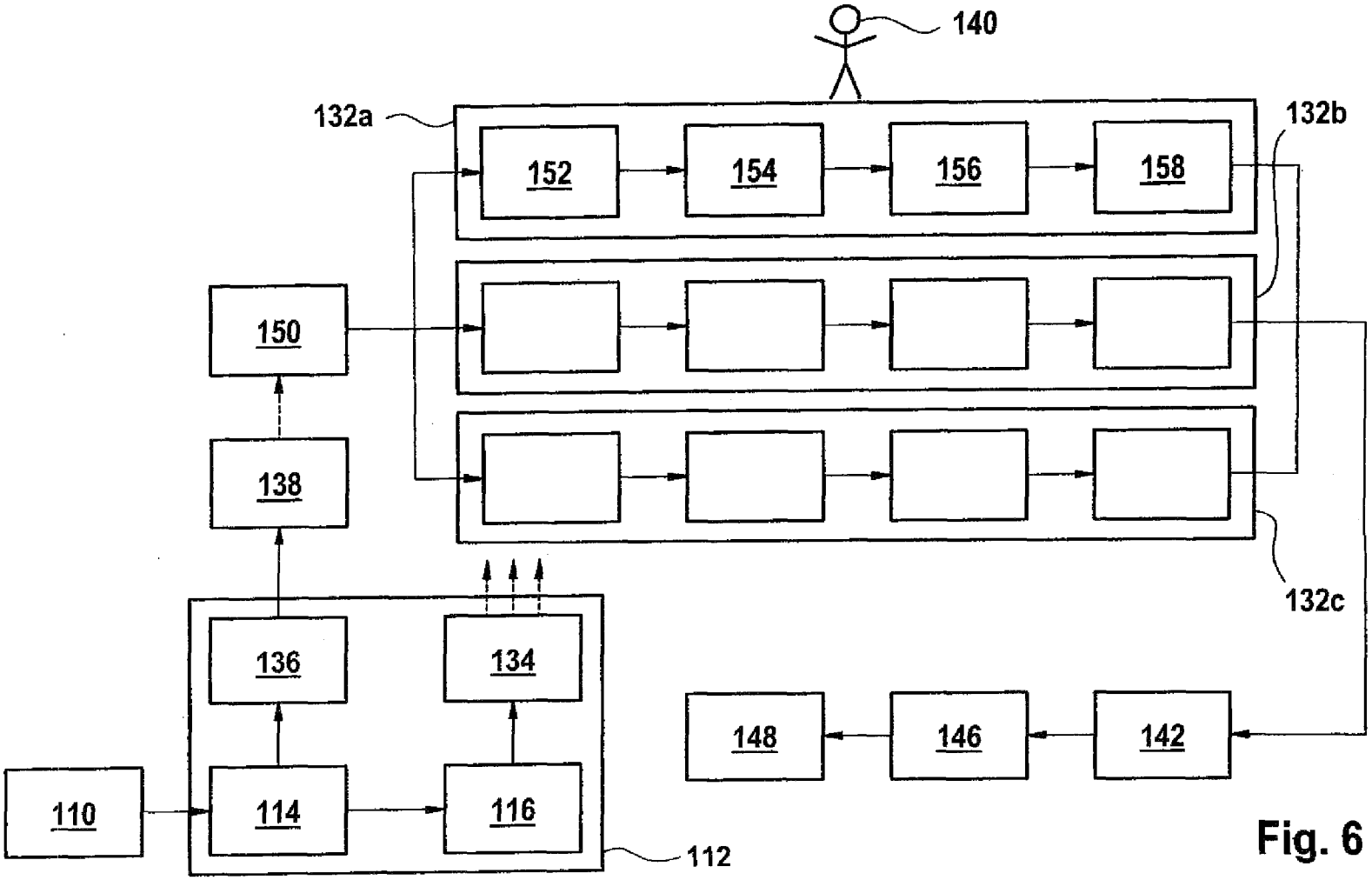
FIG. 6 is a schematic block diagram of an arrangement for an off line packing process.

Referring now to FIG. 6, a typical off line process for picking articles 12 in container 10 is described. It should be noted that elements, portions and functional blocks being equivalent to elements, portions and functional blocks of FIG. 5 will be denoted by the same reference signs and will not be described in detail once more.

In this off-line process, the articles 12 are picked in totes or carts during the picking process in the warehouse in a pre-picking station 150 according to the information contained in the picking list 138. The totes or carts are then transported to one of a plurality of packing stations 132*a*, 132*b*, and 132*c*, each packing station 132*a*, 132*b*, and 132*c* being managed by a user/packer/checker 140.

The types of containers 10 within the plurality of types of containers 10 differ from each other at least in one of shape and size. A type of inflatable dunnage bag 16 is allocated to each type of shipping container 10, or to each group of types of containers 10, the type being selected from a plurality of types of inflatable dunnage bags 16, the types of inflatable dunnage bags 16 within the plurality of types of inflatable dunnage bags 16 differing from each other at least in one of shape and size. As an example, four types of containers 10 may be provided differing from each other only in size, and four types of dunnage bags 16 may be provided differing from each other also only in size. It is to be understood, however, that it may be possible that the same type of dunnage bag 16 is be allocated to different types of containers 10.

In 152, the packer 140 selects the type of container 10 following his judgement or according to an indication on the picking list 138 provided with the tote or cart with the pre-picked articles 12, or according to an indication on a display which receives its data from container type selection means 116. In 154, he takes the pre-picked articles 14 and places them in the container 10. In 156, he further takes the dunnage bag 16 indicated on the picking list 138 or on a display according to data provided by the bag type selection means 134 or allocated to the selected container 10 according to standard allocation table and places it in and fixes it to the container 10 (step 158).

The invention claimed is:

1. A method of packing at least one article in a container, comprising:

(a) providing a plurality of containers each of a different size and/or shape, (b) providing a plurality of inflatable dunnage bags each of a different size and/or shape, (c) assigning each size and/or shape of dunnage bag to one size and/or shape of container, (d) subsequent to steps (a) through (c), identifying the at least one article to be packed, (e) selecting a container from the plurality of containers that will accommodate the identified at least one article, (f) supplying the selected container, (g) placing the identified at least one article in the selected container, (h) placing the dunnage bag assigned to the selected container in the selected container in an uninflated state, (i) closing the selected container, and (j) inflating the dunnage bag.

2. The method of claim 1 wherein the selected container has a volume, the identified at least one article has a volume, and a difference between the container volume and the identified at least one article volume is defined as a void volume, and wherein the inflated dunnage bag has a volume equal to or less than the void volume.

3. The method of claim 1, further comprising:

providing at least one hole at a specified location in a wall of the selected container, connecting an inflation valve of the dunnage bag at the hole, inflating the dunnage bag with the inflation valve, and measuring inflation of the dunnage bag through the hole.

4. The method of claim 3 further comprising automatically erecting the selected container and automatically drilling the at least one hole in the wall of the selected container.

5. The method of claim 1 wherein the step of providing a plurality of containers each of a different size and/or shape comprises providing three different sizes of containers, and wherein the step of providing a plurality of inflatable dunnage bags each of a different size and/or shape comprises providing three different sizes of inflatable dunnage bags.

6. The method of claim 1 wherein the step of providing a plurality of containers each of a different size and/or shape comprises providing four different sizes of containers, and wherein the step of providing a plurality of inflatable dunnage bags each of a different size and/or shape comprises providing four different sizes of inflatable dunnage bags.

7. The method of claim 1 wherein steps (c) through (e) are performed by warehouse management software running on a computer.

8. The method of claim 1 wherein steps (f), (i) and (j) are performed automatically, and steps (g) and (h) are performed manually.

9. The method of claim 1 wherein steps (c) through (e) are performed by warehouse management software running on a computer, wherein steps (f), (i) and (j) are performed automatically, and wherein steps (g) and (h) are performed manually.

10. The method of claim 1 further comprising the step of generating a picking list listing the identified at least one article, the selected container, and the dunnage bag assigned to the selected container.

* * * * *